US009395732B2

(12) United States Patent
Carbonini et al.

(10) Patent No.: US 9,395,732 B2
(45) Date of Patent: Jul. 19, 2016

(54) LOW-DROPOUT REGULATOR AND METHOD FOR VOLTAGE REGULATION

(75) Inventors: Alessandro Carbonini, Redavalle (IT); Paolo Draghi, Pavia (IT)

(73) Assignee: AMS AG, Unterpremstaetten (AT)

( * ) Notice: Subject to any disclaimer, the term of this patent is extended or adjusted under 35 U.S.C. 154(b) by 292 days.

(21) Appl. No.: 14/234,612

(22) PCT Filed: Jul. 6, 2012

(86) PCT No.: PCT/EP2012/063257
§ 371 (c)(1),
(2), (4) Date: Apr. 25, 2014

(87) PCT Pub. No.: WO2013/013957
PCT Pub. Date: Jan. 31, 2013

(65) Prior Publication Data

US 2014/0225580 A1 Aug. 14, 2014

(30) Foreign Application Priority Data

Jul. 27, 2011 (EP) ..... 11175617

(51) Int. Cl.
*G05F 5/00* (2006.01)
*G05F 1/575* (2006.01)
*G05F 3/24* (2006.01)

(52) U.S. Cl.
CPC . *G05F 1/575* (2013.01); *G05F 3/24* (2013.01); *G05F 5/00* (2013.01)

(58) Field of Classification Search
CPC ..... G05F 1/575; G05F 3/08; G05F 5/00; G05F 3/24
USPC ..... 323/280
See application file for complete search history.

(56) References Cited

U.S. PATENT DOCUMENTS 6,765,374 B1 7/2004 Yang et al.
8,502,514 B2 * 8/2013 Hsu ..... G05F 1/56 323/282
2005/0073286 A1 * 4/2005 Ke ..... G05F 1/575 323/280
2007/0210770 A1 9/2007 Dean
2008/0157735 A1 * 7/2008 Liu ..... G05F 1/575 323/280
2010/0033148 A1 * 2/2010 Tsai ..... G05F 1/56 323/282
2010/0164451 A1 7/2010 Cerchi et al.
2012/0187935 A1 * 7/2012 Simons ..... G05F 1/575 323/313

FOREIGN PATENT DOCUMENTS

EP 1947544 A1 7/2008

OTHER PUBLICATIONS

Hirano, Yoshifumi, Voltage regulator, May 25, 1993, Japanese patent application JPH 05127764.*
Strick et al., "Low quiescent current LDO with improved load transient", Electronics Conference, 2008, 11th International Biennial Baltic, IEEE, Piscataway, NJ, USA, Oct. 6, 2008, pp. 127-130.

* cited by examiner

*Primary Examiner* — Jessica Han
*Assistant Examiner* — Bart Iliya
(74) *Attorney, Agent, or Firm* — McDermott Will & Emery LLP

(57) ABSTRACT

A low-dropout regulator (1) comprises a differential amplifier (3) with a reference input (5) for applying a reference voltage (VIN), a feedback input (7) and an amplifier output (9). An output transistor (11) has a control connection (13) connected to the amplifier output (9), and a control section connected between a first supply potential terminal (VDD) and a voltage output (15) of the low-dropout regulator (1). A feedback branch (17) with an RC-parallel connection (19) is coupled between the voltage output (15) and the feedback input (7). A precharge circuit (30) includes a first field effect transistor (31) with a gate (32) coupled to the feedback input (7) and is configured to precharge the RC-parallel connection (19) to a threshold voltage (VTH) of the first field effect transistor (31).

19 Claims, 2 Drawing Sheets

LOW-DROPOUT REGULATOR AND METHOD FOR VOLTAGE REGULATION

The invention relates to a low-dropout regulator and to a method for voltage regulation.

Low-dropout regulators, LDOs, usually employ a differential amplifier, which controls a controlled section of an output transistor. The differential amplifier is provided with a reference voltage and a feedback voltage, which is derived from an output voltage at the output transistor. An input stage of the differential amplifier is often built with NMOS transistors, which may have an improved minimum voltage supply requirement, a lower number of branches for low power applications, a lower input offset and a prompter transient response, compared to a PMOS input stage.

However, as long as one of the reference voltage and the feedback voltage are too low to comply with a threshold voltage of the NMOS transistors of the input stage, the output transistor may be floating without being controlled correctly. As a consequence, the output voltage at the output transistor may show an overshoot at the beginning of the operation of the LDO. This may have the effect that high and unwanted currents flow through the LDO or the output transistor until a steady state for a desired output voltage is achieved.

Furthermore, if the output transistor is floating, a voltage regulation may not be performed correctly such that the output voltage stays e.g. at a ground level.

It is an object of the invention to provide an efficient concept for an improved startup behavior of a low-dropout regulator.

This object is achieved with the subject matter of the independent claims. Embodiments and developments of the invention are the subject matter of the dependent claims.

According to various embodiments, a feedback branch with an RC-parallel connection is provided between a voltage output of an LDO and a feedback input of a differential amplifier. The feedback branch is precharged to a transistor threshold of a field effect transistor by means of the RC-parallel connection and a precharge circuit connected to the feedback input. Through the precharging, a defined initial state for the input stage can be achieved, such that a defined control of the output transistor is possible without overshooting effects.

According to one embodiment, a low-dropout regulator comprises a differential amplifier with a reference input for applying a reference voltage, a feedback input and an amplifier output. An output transistor has a control connection connected to the amplifier output, and a controlled section connected between a first supply potential terminal and a voltage output of the low-dropout regulator. A feedback branch with an RC-parallel connection is coupled between the voltage output and the feedback input of the differential amplifier. The low-dropout regulator further comprises a precharge circuit, including a first field effect transistor with a gate coupled to the feedback input. The precharge circuit is configured to precharge the RC-parallel connection to a threshold voltage of the first field effect transistor.

As both the feedback branch and the gate of the first field effect transistor are connected to the feedback input, a voltage at the feedback input can initially be brought to the threshold voltage and thereby charging the RC-parallel connection, in particular the capacitance of the RC-parallel connection, to this threshold voltage. Hence, there is an initial defined voltage difference between the voltage output and the feedback input, which is based on the threshold voltage. As a consequence, controlling of the output transistor by means of the differential amplifier can start without overshooting effects even for small output voltages.

According to one embodiment, the low-dropout regulator further comprises a reference generator which is configured to provide the reference voltage as a ramping signal. For example, the ramping signal starts at a base voltage, e.g. a second supply potential or a ground potential, and ramps up to a final reference voltage, which may be provided by a band gap voltage circuit.

According to some embodiments, a rising time of the ramping signal is adapted to the RC time constant of the RC-parallel connection. For example, the rising time and the RC time constant are in the same order of magnitude.

According to some embodiments, a rising time of the ramping signal and/or the RC time constant of the RC-parallel connection are chosen such that the ramping signal is in the filter range of the RC-parallel connection, in particular a corner frequency of the RC-parallel connection. Hence, the ramping signal rises such that it can be influenced by the RC-parallel connection.

According to a further embodiment, the precharge circuit includes a series connection of a current source and a controlled section of the first field effect transistor, wherein the series connection is coupled between the first supply potential terminal and a second supply potential terminal. The precharge circuit further includes a second field effect transistor, in particular of the same conductance type as the first field effect transistor, wherein a controlled section of the second field effect transistor is coupled between the first supply potential terminal and the feedback input. The gate of the second field effect transistor is connected to the connection point of the current source and the first field effect transistor.

Accordingly, the voltage at the gate of the first field effect transistor or the feedback input, respectively, is controlled by means of the second field effect transistor on the basis of the voltage over the controlled section of the first field effect transistor. The RC-parallel connection may then be precharged by the current through the second field effect transistor.

The low-dropout regulator may be implemented as a positive LDO, which provides a positive output voltage from a positive supply voltage, or as a negative LDO, which provides a negative output voltage from a positive supply voltage. The polarity of the LDO defines a preferred conduction type of transistors of an input stage of the differential amplifier, if implemented with MOS transistors or field effect transistors.

According to one embodiment, the low-dropout regulator is configured to provide a positive voltage at the voltage output, wherein an input stage of the differential amplifier includes n-channel field effect transistors, and wherein the first field effect transistor is an n-channel field effect transistor.

According to another embodiment, the low-dropout regulator is configured to provide a negative voltage at the voltage output, wherein an input stage of the differential amplifier includes p-channel field effect transistors, and wherein the first field effect transistor is a p-channel field effect transistor.

According to these embodiments, the first field effect transistor is matched to at least one of the field effect transistors of the input stage of the differential amplifier. In particular, the first field effect transistor and the at least one field effect transistor of the input stage may have the same threshold voltage.

According to a further embodiment, the feedback branch includes a resistor, which is coupled between a second supply potential terminal and the feedback input. Hence, the resistor of the RC-parallel connection and the resistor coupling the second supply potential terminal and the feedback input form a voltage divider, which results in a non-unitary gain feedback. Accordingly, by choosing respective values for the resistors of the voltage divider, a feedback gain can be set between the reference voltage and the output voltage.

The output transistor may be an n-channel field effect transistor or a p-channel field effect transistor in various embodiments.

According to a further embodiment, the precharge circuit is coupled to the first supply potential terminals by means of a switch. During normal operation of the low-dropout regulator, if the steady state output voltage at the voltage output is achieved, a current may still flow through the precharge circuit, even if precharging is neglectable in this state. To this end, the current flow through the precharge circuit can be turned off by means of the switch. The switch may be controlled by a timer circuit, a detection circuit for detecting the steady state output voltage or the like.

According to an embodiment of a method for voltage regulation, an output transistor is provided with a control section connected between a supply potential terminal and a voltage output. Furthermore, an RC-parallel connection connected to the voltage output is provided. The control section is controlled on the basis of a comparison of a reference voltage with a feedback voltage in order to achieve an output voltage at the voltage output. The RC-parallel connection is precharged to a threshold voltage of a field effect transistor. The feedback voltage is generated on the basis of the output voltage by means of the RC-parallel connection.

Precharging of the RC-parallel connection effects that a defined voltage is present over the RC-parallel connection, thus making a defined voltage shift of the output voltage to the feedback voltage possible. For example, the feedback voltage controls a gate of a field effect transistor, such that, even if the output voltage is at a ground level, the feedback voltage at the gate of the field effect transistor is in a control range of the field effect transistor. As a consequence, regulating or controlling is possible even for low output voltages without the occurrence of voltage jumps due to over-regulating. Therefore, also over-currents are prevented.

For example, the reference voltage is provided as a ramping signal. In this case, the output voltage is controlled higher with the rising reference voltage, wherein, in particular in the beginning, a voltage shift is present between the output voltage and the reference voltage due to the precharged RC-parallel connection. If the ramping signal has achieved a final value, the capacitor of the RC-parallel connection may be discharged via the resistor of the RC-parallel connection, thus reducing the voltage drop or voltage shift over the RC-parallel connection. Hence, the output voltage assimilates to the reference voltage in this case in an exponential form. In a steady state, the capacitor of the RC-parallel connection is fully discharged and the output voltage is basically the same as the reference voltage, a unity gain factor assumed.

Dimensioning of the rising time and/or the RC-parallel connection can be done according to the various embodiments of the low-dropout regulator described above.

Further embodiments of the method become apparent from the various implementation forms and embodiments described above for the low-dropout regulator.

The text below explains the invention in detail using exemplary embodiments with reference to the drawings in which.

Figure 1:
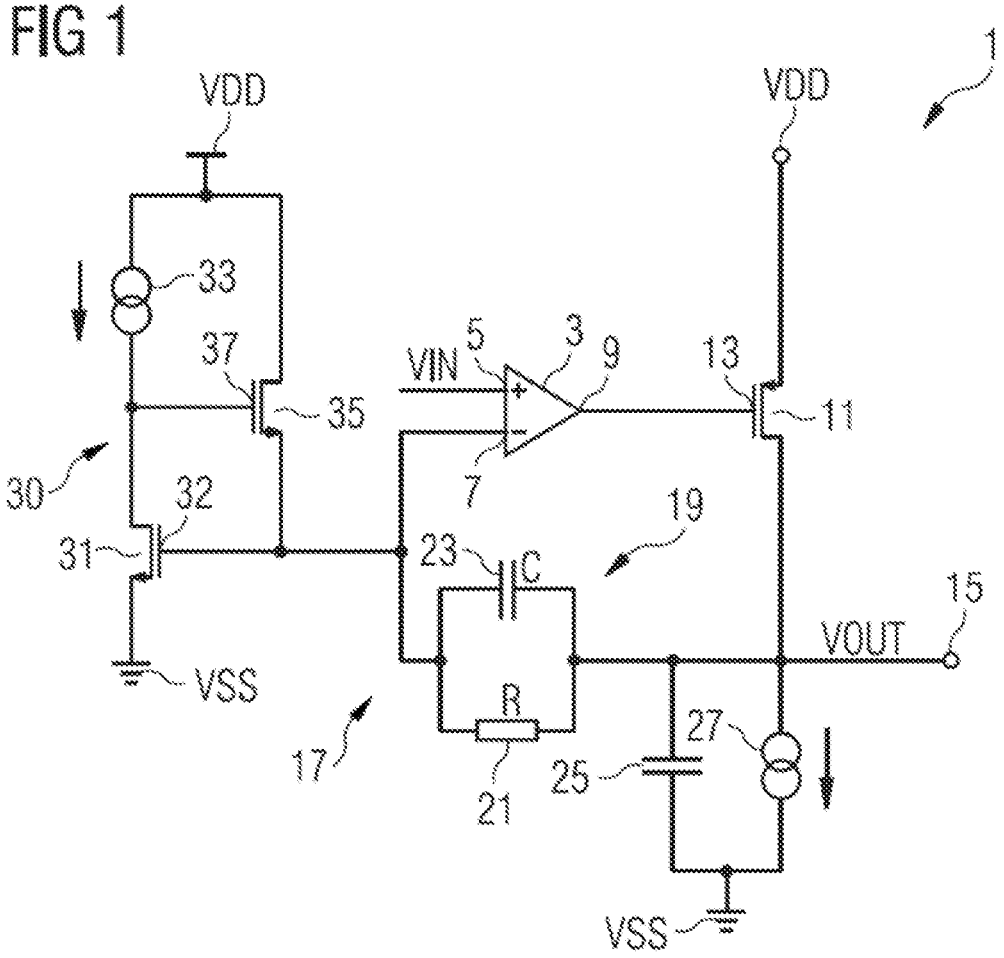
FIG. 1 shows an embodiment of a low-dropout regulator.

FIG. 1 shows an embodiment of a low-dropout regulator 1 which comprises a differential amplifier 3 with a reference input 5 for applying a reference voltage VIN, a feedback input 7 and an amplifier output 9. An output transistor 11 is formed by a PMOS transistor, whose control connection or gate 13 is connected to the amplifier output 9. A controlled section of the output transistor 11 is connected between a first supply potential terminal VDD and a voltage output 15 for providing an output voltage VOUT. The voltage output 15 is connected to the feedback input 7 by means of a feedback branch 17 which comprises an RC-parallel connection 19 having a resistor 21 and a capacitor 23. The voltage output 15 is further connected to a second supply potential terminal VSS by means of a parallel connection of an output capacitor 25 and a current source 27.

The low-dropout regulator 1 further comprises a precharge circuit 30, which includes a series connection of a current source 33 and a controlled section of a first field effect transistor 31. In particular, the current source 33 is connected to the first supply potential terminal VDD and to a drain connection of the NMOS transistor 31. A source connection of the NMOS transistor 31 is connected to a second supply potential terminal VSS. A gate 32 of the transistor 31 is connected to the feedback input 7 and therefore also to the RC-parallel connection 19 of the feedback branch 17. The precharge circuit 30 further includes a second field effect transistor 35, which is also embodied as an NMOS field effect transistor. A drain connection of the transistor 35 is connected to the first supply potential terminal VDD, a source connection of the transistor 35 is connected to the gate 32 of the first transistor 31 and the feedback input 7, respectively. A gate 37 of the second transistor 35 is connected to a connection point of the current source 33 and the first transistor 31.

The differential amplifier 3 is shown as an operational amplifier for the purpose of a better overview. However, the differential amplifier 3 may include an input stage for receiving the reference voltage VIN at reference input 5 and a feedback voltage at the feedback input 7. The input stage of the differential amplifier 3 may be implemented with NMOS transistors in this case, similar to the first and the second transistor 31, 35 of the precharge circuit 30. In particular, the first transistor 31 may be matched to the transistors of the input stage of the differential amplifier 3.

During operation of the low-dropout regulator 1, the output voltage VOUT at the voltage output 15 is controlled by the differential amplifier 3 by means of the output transistor 11, such that the feedback voltage at the feedback input 7 derived from the output voltage VOUT is the same as the reference voltage VIN at the reference input 5. Due to the feedback branch 17, the feedback voltage follows the output voltage VOUT, wherein the feedback voltage and the output voltage VOUT may differ about a charging voltage of the capacitor 23. In particular, a charging of the capacitor 23 and therefore the RC-parallel connection 19 may be performed by the precharge circuit 30 via a current through the second field effect transistor 35.

Figure 2:
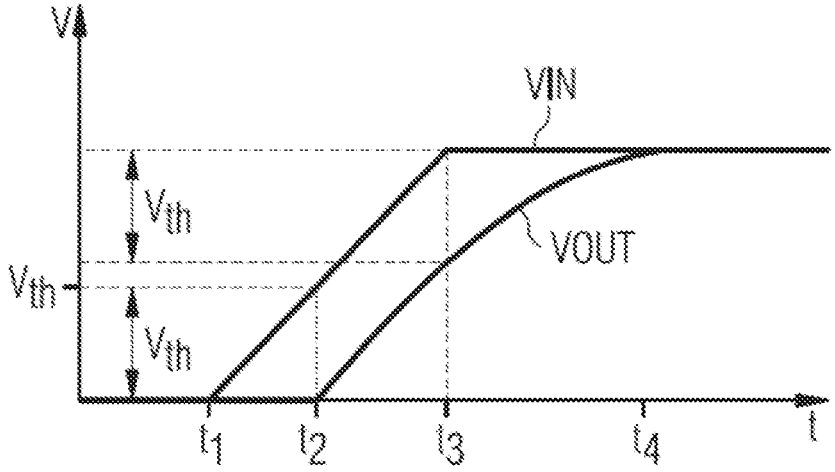
FIG. 2 shows a signal-time diagram of voltages within such low-dropout regulator.

A more detailed function of the low-dropout regulator 1 is described in conjunction with the signal-time diagram shown in FIG. 2. FIG. 2 shows an exemplary reference voltage VIN, which is a ramping signal starting from a base value and ending at a final value in this embodiment.

At times $t<t1$, the reference voltage VIN is at a base level, for example the potential at the second supply potential terminal VSS. Initially, the first transistor 31 is turned off, while the gate 37 of second transistor 35 is pulled up by the current of current source 33. Hence, the gate voltage at gate 32 starts to rise, which opens the transistor 31. As a consequence, the gate voltage at gate 37 of the second transistor 35 starts falling, thus is closing the second transistor 35. The precharge circuit 30 will convert to a state where a voltage at the gate 32 of the first transistor 31 is set, which corresponds to the threshold voltage of the transistor 31. As the output transistor 11 is in a closed state during this time frame, the output voltage VOUT will be at the voltage of the second supply potential terminal VSS. Accordingly, the RC-parallel connection 19 and the capacitor 23, respectively, is charged to the threshold voltage at the gate 32. As a consequence, there is a defined potential at the feedback input 7 of the amplifier 3.

At times t1<t<t2, the reference voltage VIN is still smaller than the threshold voltage VTH, such that an output of the amplifier 3 at the amplifier output 9 keeps the output transistor 11 in a closed state, resulting in the output voltage VOUT being held at the voltage of the second supply potential terminal VSS.

At t2, the reference voltage VIN becomes larger than the threshold voltage VTH. Hence, for times t2<t<t3, the output transistor 11 is controlled open due to the reference voltage VIN being greater than the feedback voltage. Furthermore, as the output transistor 11 is controlled open, the output voltage VOUT begins to rise. As the capacitor 23 and the RC-parallel connection 19, respectively, are still precharged, the feedback voltage at the feedback input 7 rises accordingly, keeping basically the difference of the precharged threshold voltage VTH between the voltage output 15 and the feedback input 7. Furthermore, at the time t2, the capacitor 23 begins to discharge via the resistor 21.

As with the feedback input 7, also the gate 32 of the first transistor 31 rises, this transistor 31 is pulled open, resulting in a fixed current defined by the current of the current source 33. The second transistor 35 is pulled closed in consequence.

At time t3, the reference voltage VIN reaches its final value and stays constant for times t>t3. The capacitor 23 continues to discharge via the resistor 21 such that the amplifier 3 further increases the output voltage VOUT by means of the output transistor 11 to compensate for the decreasing charging voltage of the capacitor 23. As a consequence, the output voltage VOUT assimilates to the reference voltage VIN in an exponential curve. The output voltage VOUT may reach the final value of the reference voltage VIN, for example, at time t4. The final value of the reference voltage VIN may be provided by a band gap circuit, for example.

Because of the precharging of the RC-parallel connection 19, regulation by means of the differential amplifier 3 can start from the beginning of the provision of the reference voltage without the output transistor 11 being in a floating state. Hence, a jump of the output voltage VOUT can be avoided, which could occur without precharging in order to let the control loop being regulated by the feedback input 7. Furthermore, a current in the output transistor 11 can be kept low in this case because as soon as a current increases, the feedback voltage rises to reduce it. Hence, the current through the output transistor 11 is limited regarding the regulation in these embodiments.

Figure 3:
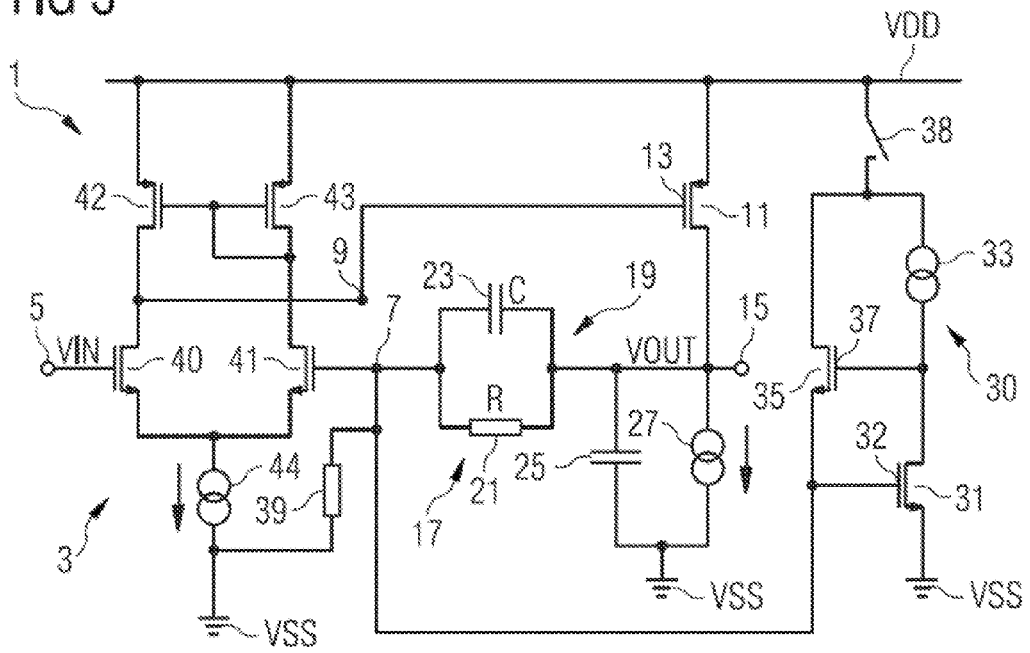
FIG. 3 shows a further embodiment of a low-dropout regulator.

FIG. 3 shows another embodiment of a low-dropout regulator 1, which is based on the embodiment shown in FIG. 1. Accordingly, elements having the same reference numerals denote the same function and will not be explained in full detail for this figure.

The precharge circuit 30 additionally comprises a switch 38 in this embodiment, which makes it possible to turn off a current through the precharge circuit. For example, if a steady state of the output voltage VOUT is achieved, precharging of the RC-parallel connection 19 and clamping of the feedback input 7 is not necessary in this state. Furthermore, the second transistor 35 is turned off in a steady state. Hence, the switch 38 can be controlled open, if the output voltage VOUT has reached a final value of the reference voltage VIN, which may be detected by a detection circuit or controlled by a timer circuit. If no current flows through the precharge circuit 30, power can be saved.

Furthermore in this embodiment, a second resistor 39 is connected between the feedback input 7 and the second supply potential terminal VSS, thus forming a voltage divider with the first resistor 21 between the voltage output 15 and the second supply potential terminal VSS. This results in a feedback gain which is determined by the ratio of resistance values of the resistors 21, 39. Precharging of the RC-parallel connection 19 is unaffected by the second resistor 39.

The differential amplifier 3 comprises an input stage with two n-channel MOSFETs 40, 41, whose gates are forming the reference input 5 and the feedback input 7, respectively. In the current paths of the transistors 40, 41, a current mirror with PMOS transistors 42, 43 is arranged. Preferably, the transistors 40, 41 of the differential amplifier 3 are matched to the transistor 31 of the precharge circuit 30, in particular regarding their threshold voltage VTH. A current source 44 provides a tail current of the differential amplifier 3.

Regarding the function of the embodiment of the low-dropout regulator shown in FIG. 3, similar signals as described in conjunction with FIG. 2 are present. However, due to the second resistor 39 and the different gain factor resulting from this second resistor 39, the output voltage VOUT does not follow the reference voltage in the same order of magnitude but with the gain factor applied. Due to the precharging and the voltage stored on the capacitor 23, the signal form of the output voltage VOUT is similar to the one shown in FIG. 2.

Figure 4:
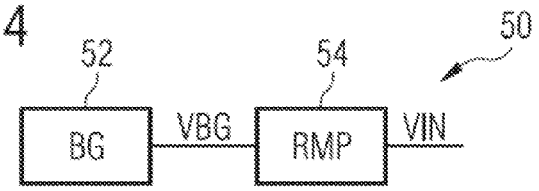
FIG. 4 shows an embodiment of a reference generator.

FIG. 4 shows an exemplary embodiment of a reference generator 50 for providing the reference voltage VIN. The reference generator 50 comprises a band gap circuit 52 which provides a band gap voltage VBG to a ramping circuit 54. The ramping circuit 54 generates a ramping signal, for example, like shown in FIG. 2, which rises from a base value to the band gap voltage VBG, for example.

Figure 5:
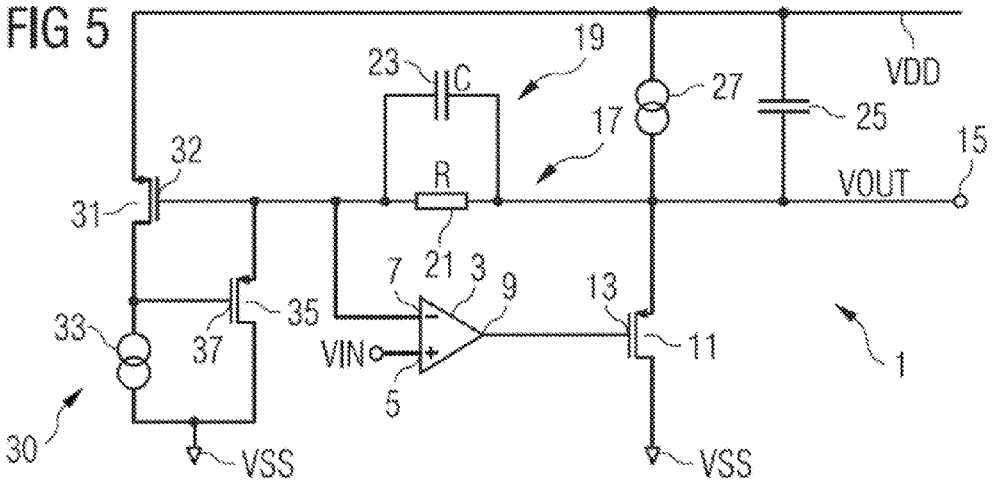
FIG. 5 shows a further embodiment of a low-dropout regulator.

FIG. 5 shows a further embodiment of a low-dropout regulator which is similar to the embodiment shown in FIG. 1. However, the low-dropout regulator 1 of FIG. 5 is implemented as a negative LDO providing a negative output voltage VOUT between the voltage output 15 and the first supply potential terminal VDD.

The low-dropout regulator 1 comprises a differential amplifier 3 having a reference input 5 and a feedback input 7, wherein an input stage of differential amplifier 3 is implemented with PMOS field effect transistors. The differential amplifier 3 controls the output transistor 11 which is connected between the second supply potential terminal VSS and the voltage output 15. Accordingly, the output capacitor 25 and the current source 27 are connected between the voltage output 15 and the first supply potential terminal VDD. As in the embodiment of FIG. 1, a feedback branch 17 with the RC-parallel connection 19 is connected between the voltage output 15 and the feedback input 7. With respect to the embodiment of FIG. 1, the precharge circuit 30 is turned around and implemented with PMOS field effect transistors instead of NMOS field effect transistors. In particular, a series connection of the current source 33 and the first transistor 31 is connected between the first supply potential terminal VDD and the second supply potential terminal VSS such that the current source 33 has one end connected to the second supply potential terminal VSS. The second transistor 35 is connected between the second supply potential terminal VSS and the feedback input 7, wherein the gate 37 of the second transistor 35 is connected to the connection point of the current source 33 and the first transistor 31. The gate 32 of the first transistor 31 is connected to the feedback input 7 and the RC-parallel connection 19, respectively.

The output voltage VOUT is referenced to the first supply potential terminal VDD. Similarly, the reference voltage VIN at the reference input 5 may also be referenced to the first supply potential terminal VDD. The output transistor 11 is implemented as a PMOS field effect transistor in this embodiment. In further embodiments, the output transistor 11 can be replaced by an NMOS field effect transistor, wherein in this case the polarity of the differential amplifier is changed regarding its inverting and non-inverting inputs.

The function and effects of the embodiments of FIG. 5 are similar to the ones described for the embodiments of FIG. 1 and FIG. 3, in particular regarding the precharging of the RC-parallel connection 19 and the immediate ability to start voltage regulation due to the precharged voltage. Hence, also for the negative LDO, overshooting of the output voltage VOUT in a startup phase of operation is eliminated or reduced.

In the various embodiments of the low-dropout regulator, the precharge circuit is preferably, but not exclusively, based on a feedback structure to make a safe switching off possible after startup completion. The first transistor 31 provides the precharged voltage, hence is preferably matched to the transistor at an input pair of the differential amplifier 3 and is of the same conductance type. The current source 33 determines a voltage drop at the gate 32 of transistor 31. The second transistor 35 provides the charge at the feedback input 7 of the differential amplifier 3. Resistor 21 and capacitor 23 of the RC-parallel connection 19 have one terminal coupled to a feedback input 7 and another terminal coupled to the voltage output 15. Hence, at startup of the low-dropout regulator 1, the RC-parallel connection 19 is precharged. The capacitor 23 tends to keep the charge even after the precharge circuit 30 has finished its action. Therefore, the resistor 21 decreases the voltage drop across the capacitor 23 to zero to ensure that no residual charge from the precharging action remains at steady state conditions.

In the described embodiments, the reference voltage VIN is a ramping signal. As soon as the reference voltage reaches the precharged voltage, for example the threshold voltage of transistor 31, the gate of the PMOS output transistor 11 is pulled low to make the output voltage VOUT increase. As soon as the output voltage VOUT increases, the feedback input 7 is bootstrapped and tends to track the incoming ramping signal of the reference voltage. As a consequence, the precharge circuit 30 is turned off. Furthermore, the falling of the gate 13 of the output transistor 11 is counteracted and the current through the transistor 11 is reduced. As in the meantime, the RC-parallel connection 19 starts getting discharged because the precharge circuit 30 is no longer active, the output voltage VOUT is increased in order to keep the control loop in regulation. The output voltage VOUT is increased with a slope given as the sum of the incoming ramping signal and the decrease rate of the RC-parallel connection 19. This makes it possible that a smooth profile for the output voltage VOUT can be achieved. Furthermore, a voltage difference between the reference input 5 and the feedback input 7 is kept small any time, thus resulting in that the gate 13 of the output transistor 11 is not overdriven to provide a large current. This eliminates any overshoot occurrence in startup transients.

The embodiments described above, in particular single features of these embodiments, can be combined in various ways.

REFERENCE LIST

1 low-dropout regulator
3 differential amplifier
5 reference input
7 feedback input
9 amplifier output
11 output transistor
13 gate
15 voltage output
17 feedback branch
19 RC-parallel connection
21, 39 resistor
23, 25 capacitor
27 current source
30 precharge circuit
31, 35 transistor
32, 37 gate
33 current source
38 switch
40, 41, 42, 43 transistor
44 current source
50 reference generator
52 band gap circuit
54 ramping circuit
VDD, VSS supply potential terminal
VIN reference voltage
VTH threshold voltage
VOUT output voltage
VBG band gap voltage

The invention claimed is:

1. Low-dropout regulator, comprising a differential amplifier with a reference input for applying a reference voltage, a feedback input and an amplifier output;

an output transistor with a control connection connected to the amplifier output and with a controlled section connected between a first supply potential terminal and a voltage output of the low-dropout regulator;

a feedback branch with an RC-parallel connection coupled between the voltage output and the feedback input; and a precharge circuit including a first field-effect transistor with a gate coupled to the feedback input, the precharge circuit being configured to precharge the RC-parallel connection to a threshold voltage of the first field-effect transistor.

2. Low-dropout regulator according to claim 1, wherein the precharge circuit includes a series connection of a current source and a controlled section of the first field-effect transistor, the series connection being coupled between the first supply potential terminal and a second supply potential terminal, and includes a second field-effect transistor, in particular of the same conductance type as the first field-effect transistor, wherein a controlled section of the second field-effect transistor is coupled between the first supply potential terminal and the feedback input, and wherein a gate of the second field-effect transistor is connected to the connection point of the current source and the first field-effect transistor.

3. Low-dropout regulator according to claim 1 or 2, which is configured to provide a positive voltage at the voltage output, wherein an input stage of the differential amplifier includes n-channel field-effect transistors, and wherein the first field-effect transistor is an n-channel field-effect transistor.

4. Low-dropout regulator according to claim 3, wherein the first field-effect transistor is matched to at least one of the field-effect transistors of the input stage of the differential amplifier.

5. Low-dropout regulator according to claim 1 or 2, which is configured to provide a negative voltage at the voltage output, wherein an input stage of the differential amplifier includes p-channel field-effect transistors, and wherein the first field-effect transistor is a p-channel field-effect transistor.

6. Low-dropout regulator according to claim 5, wherein the first field-effect transistor is matched to at least one of the field-effect transistors of the input stage of the differential amplifier.

7. Low-dropout regulator according to claim 1, wherein the feedback branch includes a resistor, which is coupled between a second supply potential terminal and the feedback input.

8. Low-dropout regulator according to claim 1, wherein the output transistor is an n-channel field-effect transistor or a p-channel field-effect transistor.

9. Low-dropout regulator according to claim 1, wherein the precharge circuit is coupled to the first supply potential terminal by means of a switch.

10. Low-dropout regulator according to claim 1, further comprising a reference generator, which is configured to provide the reference voltage as a ramping signal.

11. Low-dropout regulator according to claim 10, wherein a rising time of the ramping signal is adapted to the RC-time constant of the RC-parallel connection.

12. Low-dropout regulator according to claim 10 or 11, wherein a rising time of the ramping signal and/or the RC-time constant of the RC-parallel connection are chosen such that the ramping signal is in the filter range of the RC-parallel connection, in particular a corner frequency of the RC-parallel connection.

13. Low-dropout regulator according to claim 1, wherein an input stage of the differential amplifier includes field-effect transistors, and wherein the first field-effect transistor is matched to at least one of the field-effect transistors of the input stage.

14. Low-dropout regulator according to claim 13, wherein the first field-effect transistor is a field-effect transistor of the same channel type as the at least one of the field-effect transistors of the input stage.

15. Method for voltage regulation, comprising providing an output transistor with a controlled section connected between a supply potential terminal and a voltage output;

providing an RC-parallel connection connected to the voltage output;

controlling the controlled section on the basis of a comparison of a reference voltage with a feedback voltage in order to achieve an output voltage at the voltage output;

precharging the RC-parallel connection to a threshold voltage of a field-effect transistor; and generating the feedback voltage on the basis of the output voltage by means of the RC-parallel connection.

16. Method according to claim 15, wherein the reference voltage is provided as a ramping signal.

17. Method according to claim 16, wherein a rising time of the ramping signal is adapted to the RC-time constant of the RC-parallel connection.

18. Method according to claim 16 or 17, wherein a rising time of the ramping signal and/or the RC-time constant of the RC-parallel connection are chosen such that the ramping signal is in the filter range of the RC-parallel connection, in particular a corner frequency of the RC-parallel connection.

19. Method according to claim 15, further comprising providing a differential amplifier with an input stage that includes field-effect transistors, wherein controlling the controlled section is performed by means of the differential amplifier, and wherein the field-effect transistor, to whose threshold voltage the RC-parallel connection is precharged, is matched to at least one of the field-effect transistors of the input stage of the differential amplifier.

* * * * *